US007093994B2

(12) United States Patent
Strobelt et al.

(10) Patent No.: US 7,093,994 B2
(45) Date of Patent: Aug. 22, 2006

(54) DOSING DEVICE AND WRITING IMPLEMENT WITH A DOSING DEVICE

(75) Inventors: Tilo Strobelt, Villingen-Schwenningen (DE); Guenther Waibel, Villingen-Schwenninoen (DE); Michael Sesterhenn, Dresden (DE); Joerg Mellmann, Williston, VT (US)

(73) Assignee: Gebr. Schmidt Fabrik fur Feinmechanik, GmbH & Co. Kg, St. Georgen (DE)

( * ) Notice: Subject to any disclaimer, the term of this patent is extended or adjusted under 35 U.S.C. 154(b) by 363 days.

(21) Appl. No.: 10/415,971

(22) PCT Filed: Oct. 31, 2001

(86) PCT No.: PCT/EP01/12647

§ 371 (c)(1),
(2), (4) Date: Nov. 24, 2003

(87) PCT Pub. No.: WO02/36361

PCT Pub. Date: May 10, 2002

(65) Prior Publication Data

US 2004/0090492 A1 May 13, 2004

(30) Foreign Application Priority Data

Nov. 3, 2000 (DE) ..... 100 54 599

(51) Int. Cl.
*B43K 5/18* (2006.01)

(52) U.S. Cl. ..... 401/242; 401/232; 401/151; 401/230

(58) Field of Classification Search ..... 401/143, 401/141, 225, 230, 232, 242, 251
See application file for complete search history.

(56) References Cited

U.S. PATENT DOCUMENTS

| | | | | |
|---|---|---|---|---|
| 4,573,819 | A | 3/1986 | Herrnring | 401/151 |
| 4,634,305 | A | 1/1987 | Herrnring | 401/151 |
| 5,443,322 | A * | 8/1995 | Jozat et al. | 401/151 |

FOREIGN PATENT DOCUMENTS

| | | |
|---|---|---|
| DE | 3211586 | 3/1982 |

(Continued)

*Primary Examiner*—Justine R. Yu
*Assistant Examiner*—Huyen Le
(74) *Attorney, Agent, or Firm*—Michael A. Glenn; Glenn Patent Group

(57) ABSTRACT

A dosing device for demand-dosing a liquid includes a primary container, a point of release for releasing the liquid, a main liquid channel between the primary container and the point of release and a vented secondary container, wherein the secondary container is coupled to the main liquid channel at a branch point, wherein the secondary container and the main liquid channel are designed such that the main liquid channel preferably fills with the liquid before the secondary container. The dosing device further includes a liquid valve between the primary container and the branch point, a sensor for measuring the filling level in the secondary container and finally means for opening the valve responsive to a predetermined filling level in the secondary container. By measuring the flow not directly in the main stream but via a filling level of a secondary container in an auxiliary stream, the secondary container can be designed independently of ambient temperature and ambient pressure so that cases of failure due to changing ambient conditions do no longer occur. A preferred application of the dosing system is the use of it in an electronic writing apparatus.

16 Claims, 3 Drawing Sheets

FOREIGN PATENT DOCUMENTS

| | | |
|---|---|---|
| DE | 3220750 | 6/1982 |
| DE | 3311364 | 3/1983 |
| DE | 3321301 | 6/1983 |
| DE | 3926271 | 8/1989 |
| DE | 4416880 | 5/1994 |
| DE | 4443212 | 12/1994 |
| EP | 096177 | 3/1983 |

* cited by examiner

DOSING DEVICE AND WRITING IMPLEMENT WITH A DOSING DEVICE

BACKGROUND OF THE INVENTION

1. Field of the Invention

The present invention relates to a dosing device and, in particular, to a dosing device for demand-dosing a liquid and to a writing apparatus having such a dosing device.

2. Description of the Related Art

An electronically controlled writing apparatus is disclosed in EP 0096177. The electronic writing apparatus includes a writing tip extending into a capillary space also referred to as the secondary supply space. The small-volume secondary supply space is fluidically connected to a large-volume primary ink supply space under pressure via an ink channel, a reload valve being arranged in the ink channel. When the fluid level in the secondary supply space is too low, the reload valve is controlled in order to open for a certain time until a sufficient amount of ink has been transported from the primary supply space into the secondary supply space so that a sufficient filling level appears there. The filling level height in the secondary supply space is measured using a capacitive sensor. The capacitive sensor is embodied as a cylinder capacitor, the capacity of which depends on the filling volume of the secondary supply space. In order to be able to measure small capacity changes, a resonance circuit digitally measuring the capacity change by detuning an oscillating circuit is used. This circuit, apart from the capacity to be measured, includes an additional capacity and a quartz oscillator. Additionally, a counting mechanism is used to be able to measure the difference of the oscillating frequencies as an indication to the capacity change.

Devices for demand-dosing form a regulating system including a supply tank, a buffer reservoir and a pressure-regulating unit. The release of the liquid is from the buffer reservoir. If the pressure in the buffer reservoir sinks below a certain threshold by releasing a liquid, the pressure in the buffer reservoir is compensated by the pressure-regulating unit by transferring liquid from the supply tank into the buffer reservoir.

Such dosing devices are vacuum-regulated or negative-pressure-regulated relative to the ambient pressure so that both the buffer reservoir and the supply tank must be closed in a pressure-tight way relative to the ambient pressure. In order to be, however, able to take a liquid from a pressure-tight vessel, a gas volume must be present in this vessel. This gas volume in turn is governed by the gas laws and, for example, expands when heated, which results in a pressure increase in the vessel. Thus the negative pressure in the vessel can be reduced so that the vacuum-regulated release of liquid no longer works. A further possible reduction of the negative pressure takes place by diminishing the ambient pressure.

In addition, such dosing devices require a unilateral connection of the supply tank and the buffer reservoir to the ambient air for the purpose of a gas inlet. This connection can, in case of a failure, result in a leakage of the liquid stored.

For certain dosing devices, as are, for example, to be used in a pen, the demand-release of a liquid is important. The amount released should be able to adapt directly to the requirements of the consumer, that is in the case of a pen to its writing speed. It must be guaranteed that the liquid stream is not interrupted in a constant or changing consumption. Such a case of failure of the interruption could, for example, occur when releasing from a closed tank since when emptying it changing pressure ratios can be present and thus the liquid stream can pulse.

A further case of failure can occur by evaporating the liquid at the point of release. Solid residues from the liquid, which in the case of a pen is the ink, could plug the release opening and not allow any further release. Thus, it must be guaranteed that either no evaporation occurs or the point of release is always wetted with a liquid. The latter case of the continuous wetting requires a liquid to flow in a regulated way according to the evaporating rate.

DE 33 21 301 A1 discloses an ink supply system for writing apparatuses operating with a liquid ink, having a large volume ink space connected to a small volume ink supply space next to the writing element via a reload valve. Transferring ink from the large volume ink space to the secondary supply space takes place in a way controlled by a sensor depending on the ink volume present in the secondary ink space. As a reload valve, a hose pump which is driven in a rotating way by an electric motor and which can produce the delivery pressure required for delivering the ink to the secondary ink space is used.

SUMMARY OF THE INVENTION

It is the object of the present invention to provide a safe dosing device for demand-dosing a liquid.

In accordance with a first aspect of the invention, this object is achieved by a dosing device for demand-dosing a liquid, comprising:

a primary container for storing the liquid; a point of release for releasing the liquid; a main liquid channel between the primary container and the point of release; a secondary container for buffering the liquid, the secondary container comprising a vent, the secondary container being connected to a branch point in the main liquid channel, and the secondary container being coupled to the main liquid channel such that the main liquid channel preferably fills with the liquid before the secondary container; a valve between the primary container and the branch point; a sensor for measuring the filling level in the secondary container; and means for opening the valve responsive to a predetermined filling level in the secondary container.

It is a further object of the present invention to provide a writing apparatus for a liquid writing medium having such a dosing device.

In accordance with a second aspect of the invention, this object is achieved by a writing apparatus for a liquid writing medium, comprising:

a dosing device having a primary container for storing the liquid; a point of release for releasing the liquid; a main liquid channel between the primary container and the point of release; a secondary container for buffering the liquid, the secondary container comprising a vent, the secondary container being connected to a branch point in the main liquid channel, and the secondary container being coupled to the main liquid channel such that the main liquid channel preferably fills with the liquid before the secondary container; a valve between the primary container and the branch point; a sensor for measuring the filling level in the secondary container; and means for opening the valve responsive to a predetermined filling level in the secondary container; writing means coupled to the point of release.

The present invention is based on the finding that the concept wherein the liquid released directly reaches the point of release from the buffer volume has to be dismissed.

Instead, in the inventive dosing device, the liquid released is fed via the main liquid channel extending directly from the primary container to the point of release. For detecting the liquid stream from the primary container via the main liquid channel to the point of release of the dosing device, a secondary container is fluidically coupled to the main fluid channel at a branch site, i.e. arranged in an auxiliary stream. The liquid level in the secondary container is measured by means of a filling level sensor which in turn feeds a valve control to control a valve in the main liquid channel provided between the primary container and the branch site. According to the invention, the secondary container is vented and coupled to the main fluid channel such that the main fluid channel preferably fills with the liquid before the secondary container.

The inventive dosing device thus uses the filling level in the auxiliary stream as a regulating quantity, while in the prior art the filling level in the main stream has been used for controlling the valve. Since the valve in the inventive dosing device actively prevents the undesired re-flow of a liquid from the primary container, apart from venting the secondary container, venting the primary container can also be provided. The gas pressures in the primary container and in the secondary container can thus always be at ambient pressure.

The flow in the main liquid channel is, according to the invention, not measured directly in the main stream itself, but via the filling level in the secondary container separated from the main stream, which is coupled to the main stream such that the main stream preferably fills before the auxiliary stream. This can be obtained in preferred embodiments of the present invention by a capillary-dimensioning of the main liquid channel and the secondary container. If liquid is released, the filling level in the secondary container sinks and vice versa. The consumption of liquid can be measured directly via this change and the re-flow can be regulated via the valve depending thereon.

An advantage of the present invention is that both the secondary container and the primary container can be embodied independently of the ambient pressure and the ambient temperature. The cases of failure caused thereby thus can no longer occur.

A further advantage of the present invention is that by a suitable selection of the surface characteristics within the secondary container and the adjacent channels, there is the possibility to configure the capillary forces such that the dosing device, when it is not to release a liquid, does not run out autonomously or the secondary volume does not run over when the pressure in the main liquid channel is increased.

A further advantage of the present invention is that the secondary container can be vented and be dimensioned by geometrically designing such that the capillary pressure in the secondary container decreases with an increasing in filling level. This can be realized in preferred embodiments of the present invention by enlarging the cross-section along the filling path. For such a disproportionate increase in the volume along the filling path in the secondary container, a clear filling or release direction can be designed in the secondary container, in particular in capillary systems.

BRIEF DESCRIPTION OF THE DRAWINGS

Preferred embodiments of the present invention will be detailed subsequently referring to the appended drawings, in which.

DESCRIPTION OF THE PREFERRED EMBODIMENTS

Figure 3A:
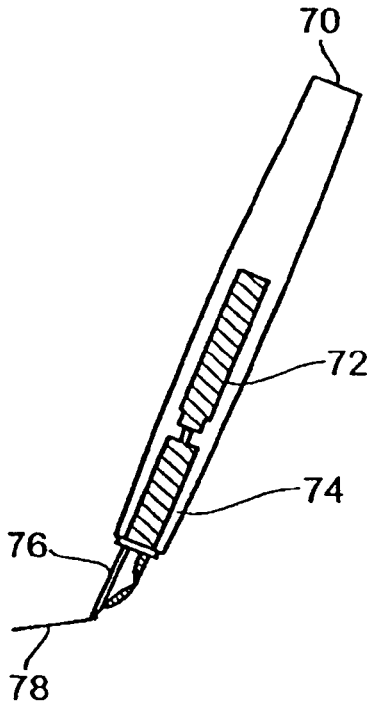
FIGS. 3*a* to 3*c* show principle sketches for discussing the function of a conventional hydrostatic pen.
Figure 3B:
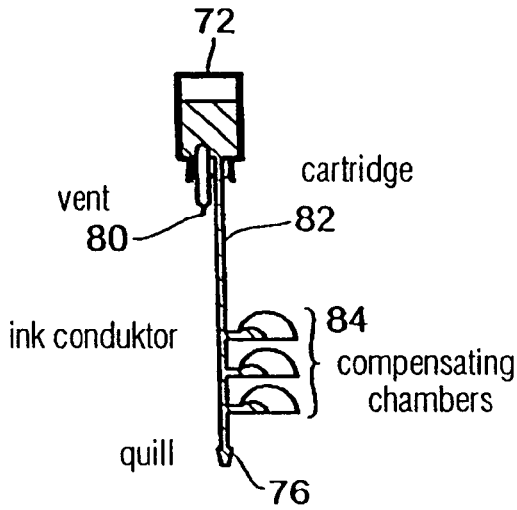
Figure 3C:
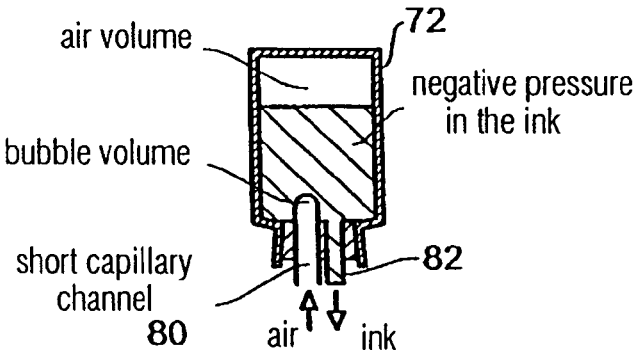

Before an inventive electronic writing apparatus, such as, for example, an electronic pen in which the dosing principle according to the present invention can be used with a special advantage will be detailed subsequently, reference will be made at first to FIGS. 3*a* to 3*c* for illustrating the general fluidic contexts. These Figures show a conventional hydrostatic pen which is not regulated electronically. The pen includes a pen casing 70 in which there is a pen cartridge 72 which is inserted in a plastic component 74. The ink is finally released via a quill 76 in order to produce a line 78.

A conventional pen can generally be considered to be a complex microdosing system. A feature of this system is that all the essential fluidic functions are integrated in the single cheap-manufacturability plastic component 74.

The fluidic system shows weaknesses when so-called cases of failure arise, such as, for example, the change of the ambient temperature and the change of the exterior air pressure, as can, for example, occur within a starting airplane.

In the following, reference is made to FIG. 3*b* in which the fluidic concept of the conventional pen is illustrated. There is, again, the cartridge 72 which has both a vent 80 and which, as an outlet, has an ink conductor 82 coupled to a plurality of compensating chambers 84 which are usually below the quill 76 of a pen. In order to be able to release ink, the ink cartridge 72 must be vented. If an unhindered air inlet was provided for this, all the ink present in the ink cartridge would be released via the quill due to the hydrostatic pressure. A regulated release, as is required for writing, would not be possible in this case. In order to enable this type of release, the vent 80 of the ink cartridge 72 is designed in the form of a short capillary channel wetted with ink. This channel only opens when a negative pressure has built up in the ink cartridge, which corresponds to the capillary pressure of the ink in the ink conductor 82. In this moment, the ink is sucked out of the channel by the negative pressure in the ink cartridge and air can flow in from outside. The process ends when the air flowing in has eliminated the negative pressure in the cartridge. In this moment the ink is wetting the short capillary channel 80 again and thus closes it.

During ventilation, ink flows from the cartridge 72. In order to avoid an uncontrolled release to the paper in this phase, the part of the ink volume not used for writing must be stored in the compensation chambers 84 forming a buffer or a secondary volume. Typically, the buffer is formed as a capillary storage below the quill 76 in the form of plane-parallel plates referred to as compensating chambers. This storage takes up the excess amount of ink and releases it again to the paper in the course of the continued writing process. If the buffer is empty, the ink required for writing is taken from the cartridge 72. The negative pressure thus increases in it and when the value decreases below the critical value, the short capillary value 80 opens again and the cycle starts anew.

When the ambient temperature changes, the air volume present in the cartridge 72 expands and displaces ink stored. The process also takes place when the exterior air pressure changes. The ink volume escaping from the cartridge 72 in such cases of failure must be taken up by the compensating chambers 84 under the quill. The usage of the system is thus strongly limited by the space available in the secondary volume under the quill.

A disadvantage of this conventional system is the limited tolerance for the case of a failure. A further disadvantage is that the reliable function of the system is strongly dependent on the tuning of the capillary pressures acting in the vent 80 and the secondary volume 84. They in turn are a function of the surface features of the materials used and thus strongly dependent on the manufacturing parameters and contaminations of the surfaces.

Figure 1:
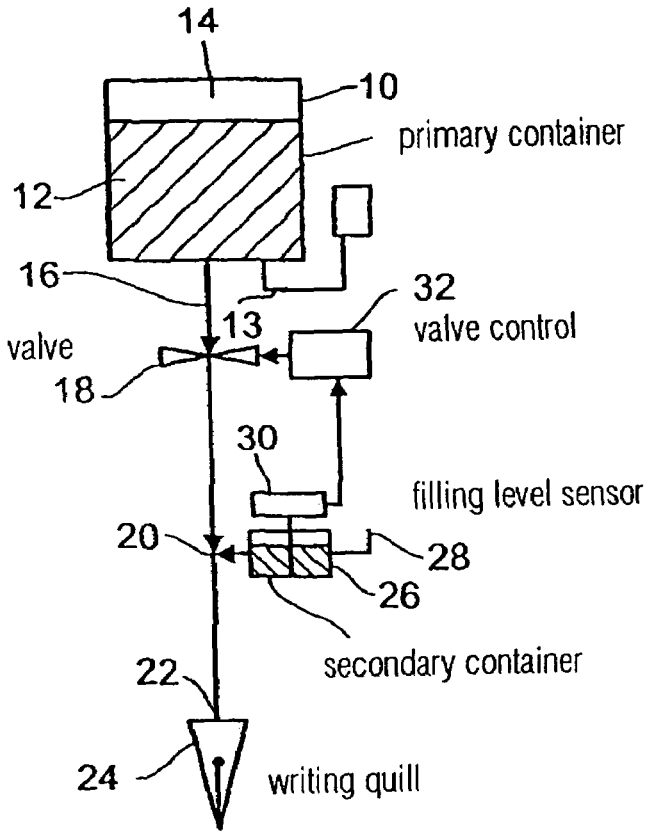
FIG. 1 shows a principle illustration of the inventive dosing device.

FIG. 1 illustrates an inventive dosing device using a principle sketch. The dosing device includes a primary container for storing a liquid 12. In the primary container 10, there is thus the liquid 12 and a gas volume 14. The primary container is connected to a main liquid channel 16 extending from an output of the primary container via a valve 18 and a branch point 20 to a point of release 22 which, in the case of using the inventive dosing device in a pen, is connected to a writing quill 24. Connected to the branch point 20 is a secondary container 26 communicating to the ambient atmosphere via a vent 28. The liquid level in the secondary container 26 is measured by means of a filling level sensor 30 feeding its measurement signals to a valve control 32 which can open and close the valve 18.

This valve, in the state of rest, is closed and avoids the release of ink from the primary container 10 to the writing quill 24 when temperature and pressure change. In operation, the valve 18 is controlled by the sensor 30 and the valve control 32. As will be discussed subsequently referring to FIGS. 2*a* to 2*c*, the sensor, in preferred embodiments of the present invention, is in the secondary container below the writing quill 24 and monitors the filling level of the secondary container 26. The secondary container is coupled via a fluidic T-piece illustrated schematically by the branch point 20 in FIG. 1 to the main liquid channel between the valve 18 and the writing quill 24. The T-piece 20 is designed, as far as capillary is concerned, such that in the first filling the front part of the quill, that is the quill tip with the grain, fills before the secondary container. The secondary container is thus realized in the form of a capillary gap, the distance of which increases continually in a preferred embodiment (which will be referred to in greater detail in FIG. 2*c*). Thus it is obtained that the effective capillary pressure decreases within an increasing filling when the volume fills in a defined way.

When writing, ink is released via the point of release 22 and the writing quill 24 from the main liquid channel. The ink is from the secondary container, when it is assumed that the valve is presently closed. The ink is, however, not released directly from the secondary container but from the main liquid channel since the secondary container communicates with the point of release only via the main liquid channel and not directly. If the ink volume in the secondary container is emptied under a defined point, the valve 18 will be opened again and ink flows to the buffer volume in the secondary container. If the filling level in the secondary container has again reached an upper limit, the valve will be closed again. The valve control can take place by means of a two-step regulator which monitors the minimum or the maximum filling level of the secondary container. In addition, an analog regulation which opens the valve corresponding to the filling level in the secondary container to a larger or a lesser degree is, however, also possible. In the inventive dosing device, the primary container can be vented or be under pressure. According to the invention, considering the high stress of the valve 18 when the primary container is under pressure, a vented primary container is preferred. It is to be pointed out that with a primary supply container under pressure a relatively strong valve is required in order to endure the pressure of the supply container. This may lead to increased costs of the overall system.

Figure 2A:
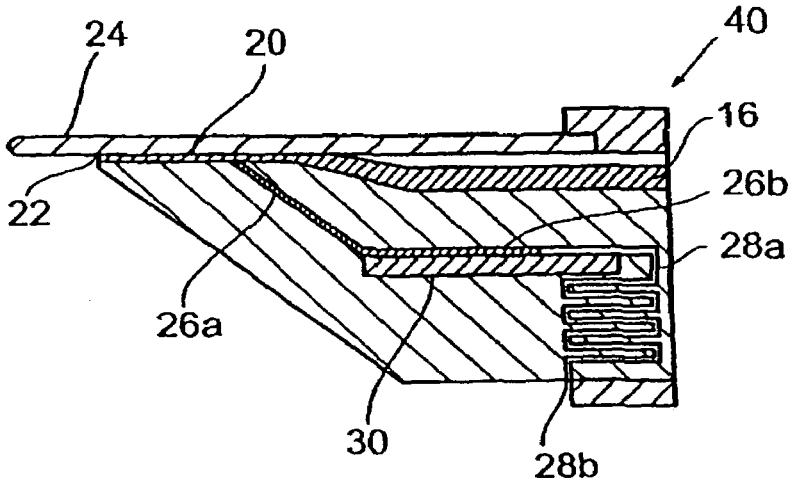
FIG. 2*a* shows a coupling of the secondary container to the main liquid channel according to an embodiment of the invention.

FIG. 2*a* shows an enlarged view of a writing tip 40 having a writing quill 24 comprising a grain 42 at its front tip. Below the writing quill 24, there is the main liquid channel 16 ending below the writing tip at the point of release 22. Within the writing tip, there is additionally the branch point 20 also referred to as the fluidic T-piece. In the auxiliary stream, there is the secondary container formed in the embodiment shown in FIG. 2*a* by an auxiliary liquid channel 26*a* and a storage region 26. Within the storage region of the secondary container 26, there is the filling level sensor 30 measuring the filling level in the storage region 26*b* of the secondary container 26. The secondary container 26 is coupled to the ambient atmosphere via an elongated meandering channel 28*a* and an opening 28*b* of the channel. The elongated meandering-formed ventilation channel 28*a* guarantees that the evaporation rate of the liquid in the secondary container 26 is minimized. For this, it is also preferred that the channel has the smallest possible cross-section and that the opening of the channel indicated by the reference numeral 28*b* is designed in a non-wetted way relative to its surroundings.

In order to guarantee the preferred filling of the main fluid channel 16, a capillary negative pressure is produced, which is larger in the main stream than in the secondary container 26. This is realized by a capillary gap in the secondary container 26 larger than in the main stream. These facts are schematically illustrated in FIG. 2*a*, wherein the drawing is, however, not according to scale.

Figure 2B:
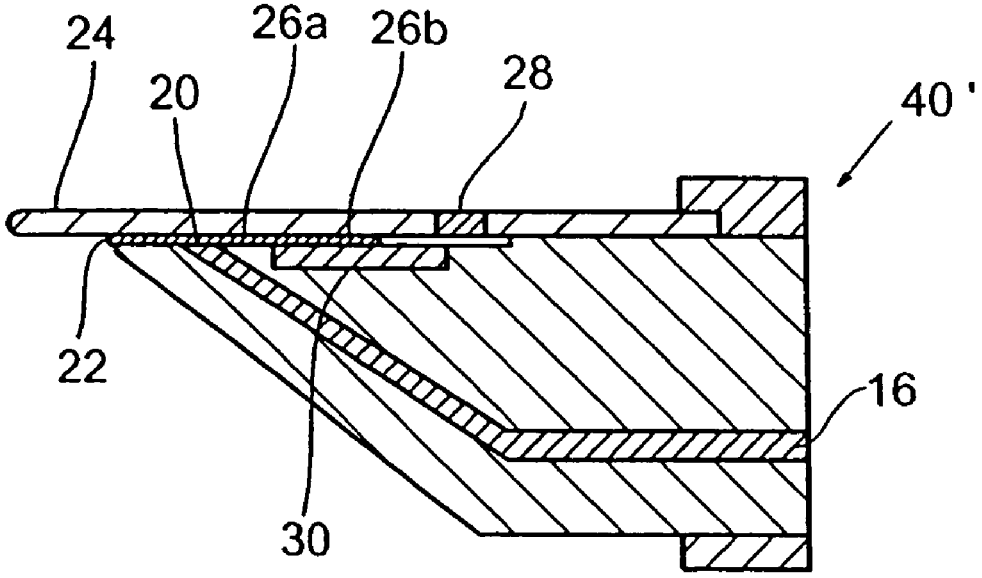
FIG. 2*b* shows a coupling of the secondary container to the main liquid channel according to a further embodiment of the present invention.

FIG. 2*b* shows an alternative design of a writing tip 40" in which the secondary container 26 is directly below the writing quill 24. This design has the advantage that the bore usually present in the writing quill can be used as a vent 28 of the secondary container 26. The preferred filling of the main fluid channel 16 in turn is guaranteed by a capillary negative pressure by embodying the capillary gap of the main stream to be larger than the capillary gap in the auxiliary stream, that is the capillary gap formed by the auxiliary liquid channel 26*a* and the storage region 26*b*.

Figure 2C:
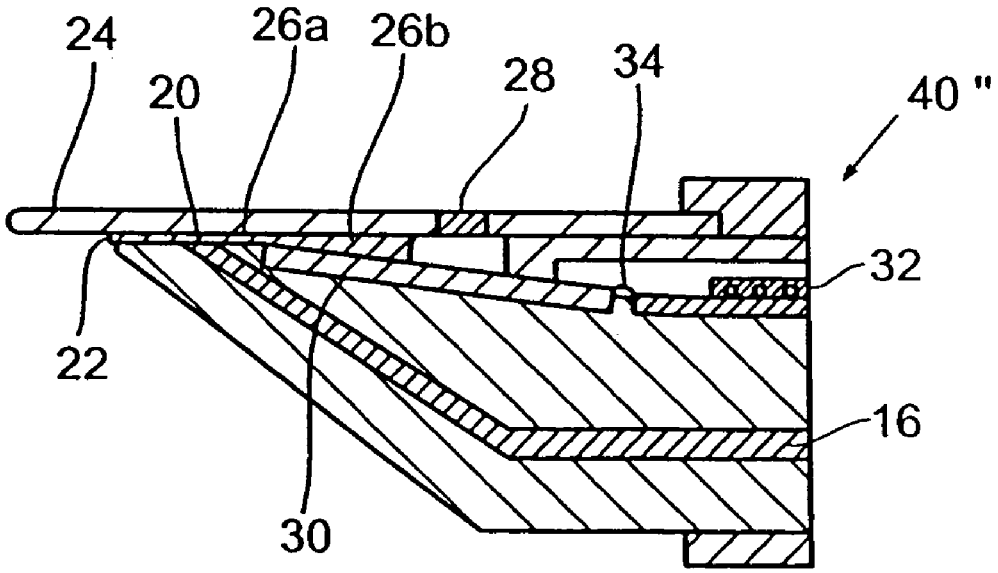
FIG. 2*c* shows a coupling of the secondary container to the main liquid channel according to a further embodiment of the present invention.

FIG. 2*c* shows another possibility of the design of the writing tip 40", wherein the secondary container in the embodiment shown in FIG. 2*c* is dimensioned such that its volume increases disproportionately in the filling direction, which is obtained by the non-parallel arrangement of the filling level sensor 30 relative to the writing quill 24. Thus, with an increasing filling level, a decreasing capillary pressure in the secondary container 26 is achieved. FIG. 2*c* additionally shows another section of the electronics belonging to the valve control 32, which can, for example, be connected to the filling level sensor 30 by means of bonding wires 34.

For all the embodiments shown in FIGS. 2*a* to 2*c*, the surface of the secondary container and the surface of the main fluid channel are to be wetting in order for the liquid, such as ink in the example of the writing apparatus, not to run out autonomously without a consumer. In contrast, the opening of the secondary container should be non-wetting relative to the surroundings in order to minimize the evaporation rate. The embodiment shown in FIG. 2*a* has the advantage compared to the vents shown in FIGS. 2*b* and 2*c* that a long channel having a small cross-section is provided. In contrast, the design shown in FIGS. 2*b* and 2*c* is simple to realize since the opening does not have to be provided specially wherein the bore usually present in the writing quill 24 can be employed.

Different sensors can be employed as filling level sensors, such as, for example, a conductivity sensor, a resonance sensor, an optical sensor or a capacitive sensor. For the application of the inventive dosing device in an electronic pen, a capacitive filling level sensor comprising an electrode arrangement, a passivation layer arranged on the electrode arrangement and a contact electrode is preferred. In this preferred capacitive filling level sensor, the contact electrode is in an electrically conductive contact to the electrically conductive ink so that the electrically conductive ink acts as a capacitor electrode, the electrode arrangement acts as another capacitor electrode and the area of the passivation layer wetted by the electrically conductive liquid acts as a dielectric of a measurement capacitor, the capacity of which depends on the degree of wetting of the passivation layer by the electrically conductive liquid. Such a sensor excels, due to the usage of the liquid to be measured as an electric conductor and thus as a capacitor plate, by a high sensitivity and by a very low dependence on the liquid to be measured.

Suitable materials for designing the main fluid channel and the secondary container are polypropylene (PP), polycarbonate (PC) or LCP. These materials, in themselves, are non-wetting but can be activated and etched well in order to have wetting surface features. In particular, ABS is to be mentioned for the wetting materials.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A dosing device for demand-dosing a liquid, comprising:

a primary container for storing the liquid;

a point of release for releasing the liquid;

a main liquid channel between the primary container and the point of release;

a secondary container for buffering the liquid, the secondary container comprising a vent, the secondary container being connected to a branch point in the main liquid channel, and the secondary container being coupled to the main liquid channel such that the main liquid channel preferably fills with the liquid before the secondary container;

a valve between the primary container and the branch point;

a sensor for measuring the filling level in the secondary container; and means for opening the valve responsive to a predetermined filling level in the secondary container.

2. The dosing device according to claim 1, wherein the primary container is vented and has a gas pressure corresponding to the ambient pressure.

3. The dosing device according to claim 1, wherein the preferred filling of the main liquid channel before the secondary container is achieved by a different capillary dimensioning of the two elements.

4. The dosing device according to claim 3, wherein the capillary negative pressure in the main liquid channel is larger than in the secondary container.

5. The dosing device according to claim 4, wherein a capillary gap of the main liquid channel is larger than a capillary gap of the secondary container.

6. The dosing device according to claim 1, wherein the secondary container has an auxiliary liquid channel at its end directed towards the branch point, connecting the branch point to a storage region of the secondary container, wherein the sensor is arranged in the storage region of the secondary container.

7. The dosing device according to claim 1, wherein the surface of the main fluid channel is wetting.

8. The dosing device according to claim 1, wherein the surface of the secondary container is wetting.

9. The dosing device according to claim 1, wherein the secondary container comprises a capillary pressure depending on the filling level.

10. The dosing device according to claim 9, wherein a cross-section of the secondary container perpendicularly to the filling direction increases with an increasing filling direction.

11. The dosing device according to claim 1, wherein the vent of the secondary container is realized by an opening to the surroundings, wherein the opening is arranged at the secondary container such that it is only reached by the liquid when the secondary container is filled to a maximum.

12. The dosing device according to claim 11, wherein the opening is designed to be non-wetting.

13. The dosing device according to claim 11, wherein the opening has a small cross-section and is fluidically connected to the secondary container via a large channel length.

14. A writing apparatus for a liquid writing medium, comprising:

a dosing device having a primary container for storing the liquid;

a point of release for releasing the liquid;

a main liquid channel between the primary container and the point of release;

a secondary container for buffering the liquid, the secondary container comprising a vent, the secondary container being connected to a branch point in the main liquid channel, and the secondary container being coupled to the main liquid channel such that the main liquid channel preferably fills with the liquid before the secondary container;

a valve between the primary container and the branch point;

a sensor for measuring the filling level in the secondary container; and means for opening the valve responsive to a predetermined filling level in the secondary container;

writing means coupled to the point of release.

15. The writing apparatus according to claim 14, being designed as a pen in which the liquid writing medium is ink and in which the writing means is a quill.

16. The writing apparatus according to claim 15, wherein the vent of the secondary container is realized by a bore in the quill.

* * * * *